US007559439B2

(12) United States Patent
Cellini et al.

(10) Patent No.: US 7,559,439 B2
(45) Date of Patent: Jul. 14, 2009

(54) SELF-DEFENSE AND SAFETY TOOL

(75) Inventors: Vito Cellini, San Antonio, TX (US); Richard W. Martin, San Antonio, TX (US); L. David Parker, Quinlan, TX (US)

(73) Assignee: Lightstick Partners, LLC, San Antonio, TX (US)

( * ) Notice: Subject to any disclaimer, the term of this patent is extended or adjusted under 35 U.S.C. 154(b) by 1144 days.

(21) Appl. No.: 10/686,541

(22) Filed: Oct. 15, 2003

(65) Prior Publication Data

US 2004/0188471 A1 Sep. 30, 2004

Related U.S. Application Data

(63) Continuation-in-part of application No. 09/970,095, filed on Oct. 3, 2001, now Pat. No. 6,786,368, which is a continuation-in-part of application No. 09/850,308, filed on May 7, 2001, now abandoned.

(51) Int. Cl.

| | |
|---|---|
| ***B05B 11/00*** | (2006.01) |
| ***B65D 5/66*** | (2006.01) |
| ***B65D 88/54*** | (2006.01) |
| ***B67B 5/00*** | (2006.01) |
| ***B67D 5/64*** | (2006.01) |

(52) U.S. Cl. ..... 222/78; 222/113; 222/192; 222/153.13; 222/162; 222/175; 222/325

(58) Field of Classification Search ..... 222/3, 222/78, 113, 130, 153.13, 153.14, 162, 173, 222/192, 325, 404

See application file for complete search history.

(56) References Cited

U.S. PATENT DOCUMENTS

| | | | | |
|---|---|---|---|---|
| 2,625,764 | A * | 1/1953 | O'Brien | 42/146 |
| 3,716,170 | A * | 2/1973 | Mangels | 222/162 |
| 3,776,429 | A * | 12/1973 | DeLucia | 222/162 |
| 5,086,377 | A * | 2/1992 | Roberts | 362/102 |
| 5,673,819 | A * | 10/1997 | Brunswig | 222/113 |
| 5,683,168 | A * | 11/1997 | Teig et al. | 362/96 |
| 5,941,629 | A * | 8/1999 | Tuscher | 362/253 |

* cited by examiner

*Primary Examiner*—Kevin P Shaver
*Assistant Examiner*—Melvin A Cartagena
(74) *Attorney, Agent, or Firm*—Christopher L. Makay

(57) ABSTRACT

A tool for self-defense and safety includes a body defining a canister compartment and a flashlight compartment. A flashlight head is securable to the body at a first end. A switch assembly is housed by the body and regulates power delivery to the flashlight head from a battery disposed in the flashlight compartment. A nozzle is securable to the body at a second end. Actuation of a trigger assembly ejects spray through the nozzle from a spray canister disposed in the canister compartment. The trigger assembly is mounted on the body proximate to the switch assembly such that either the trigger assembly or the switch assembly may be actuated without changing grip on the body. In addition, a user may strike with the tool without changing grip on the body.

13 Claims, 2 Drawing Sheets

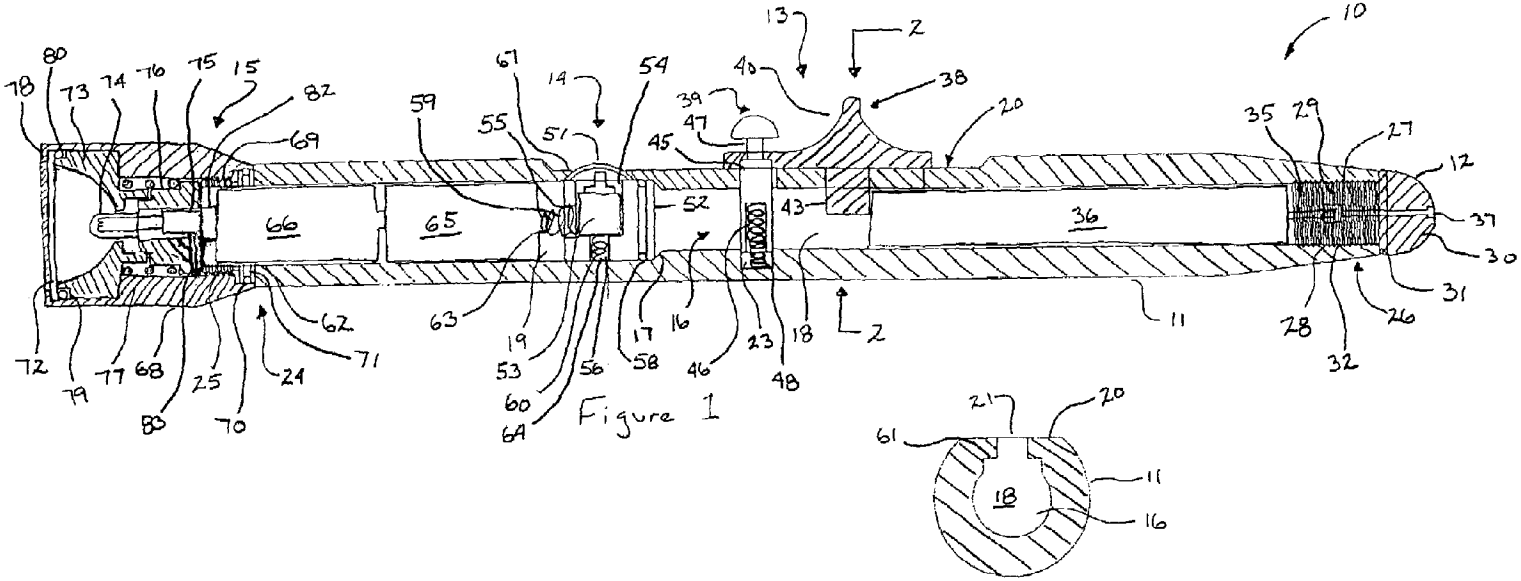
Figure 1
Figure 2
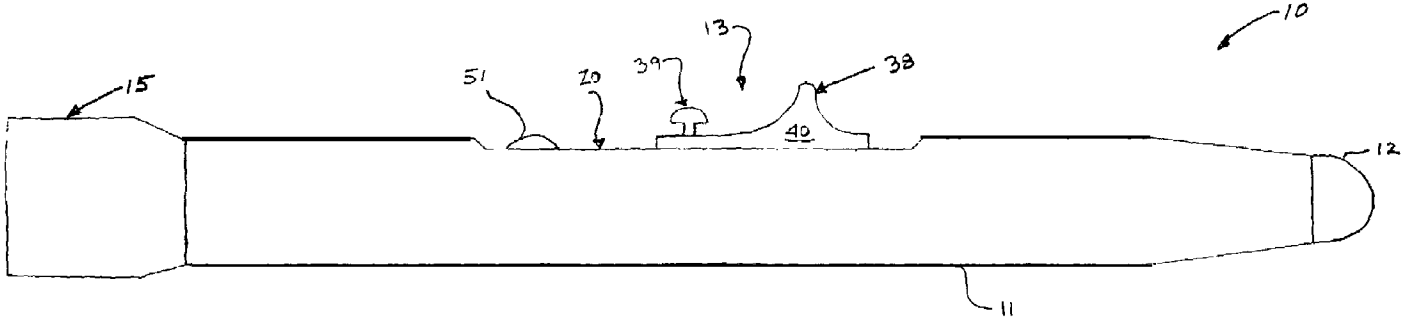
Figure 3

SELF-DEFENSE AND SAFETY TOOL

CROSS-REFERENCES TO RELATED APPLICATIONS

This application is a continuation-in-part of application Ser. No. 09/970,095, filed Oct. 3, 2001, now U.S. Pat. No. 6,786,368 which is a continuation-in-part of application Ser. No. 09/850,308, filed May 7, 2001, and now abandoned.

BACKGROUND OF THE INVENTION

1. Field of the Invention

The present invention relates to apparatus utilized in self-defense and, more particularly, but not by way of limitation, to a baton suitable for use in self-defense.

2. Description of the Related Art

Personal self-defense against criminal attack is often problematic, particularly for women, as physical size and strength are important factors because cowardly criminals prey on those weaker than themselves. Further, criminals often resort to the use of weapons, which makes a criminal attack deadly serious.

To counterbalance size and strength considerations as well as an armed criminal, law-abiding citizens often also arm themselves to fend off criminal attacks. A gun presents a most effective weapon to thwart a criminal attack because it permits a physically weaker victim to defend against a stronger or even armed assailant. Although very effective, carrying a gun presents several problems. First, many states in the United States and many countries prohibit the carrying of guns by their law-abiding citizens. Thus, an armed citizen merely seeking to defend herself becomes a criminal. Second, a gun turns any encounter into a potentially lethal one for the intended victim as well as the criminal.

Many law-abiding citizens therefore seek non-lethal methods to defend themselves against criminal attack. A popular non-lethal method involves ejecting a spray, such as pepper spray, mace, and the like, onto a criminal assailant and, in particular, into the face and eyes of such an assailant. Various devices currently exist that eject incapacitating spray; unfortunately, such devices are often difficult to operate in that they include complicated safeties and are aimed in a manner that places the device near the user's face, which results in the potential spraying of the user as well as the criminal assailant.

Accordingly, an apparatus adapted to eject a spray that is both simple to operate and aim is highly desirable. Further, an apparatus that offers a striking capability and a light supply as well as the ejection means provides a versatile self-defense and safety tool.

SUMMARY OF THE INVENTION

In accordance with the present invention, a tool includes a body defining a canister compartment and a flashlight compartment, a flashlight head, a switch assembly, a nozzle, and a trigger assembly. The flashlight head is securable to the body at a first end. The switch assembly is housed by the body and regulates power delivery to the flashlight head from a battery disposed in the flashlight compartment. The switch assembly includes a switch housing and a switch disposed in the switch housing and electrically connected to a positive terminal and a negative terminal. The switch housing is disposed in the body provides a fluid tight seal between the flashlight compartment and the canister compartment. The switch protrudes through a switch aperture in the body to permit actuation thereof. The switch assembly further includes a switch cap that mounts over the switch aperture.

The nozzle is securable to the body at a second end, and the trigger assembly is mounted on the body proximate to the switch assembly such that either the trigger assembly or the switch assembly may be actuated without changing grip on the body. Further, a user may strike with the tool without changing grip on the body. Actuation of the trigger assembly ejects spray through the nozzle from a spray canister disposed in the canister compartment. The nozzle includes a passageway therethrough, and a cavity receives a delivery tube of the spray canister therein to communicate spray into the passageway.

The trigger assembly includes a trigger movable between an unfired position and a fired position that ejects spray through the nozzle from a spray canister disposed in the canister compartment. The trigger assembly further includes a safety coupled with the trigger to lock the trigger in the unfired position. The trigger mounts on the body and extends therein via a trigger aperture. The safety mounts on the body and extends therein via a safety aperture. The trigger and safety mount on the body in a location that permits gripping of the body underhanded with the thumb positioned over the safety and the trigger to permit the thumb to release the safety and move the trigger from the unfired position to the fired position.

A method of self-defense includes gripping a tool underhanded with the thumb positioned over a trigger located proximate to a switch assembly and moving the trigger with the thumb from an unfired position to a fired position that ejects spray from a spray canister disposed in the tool. The method of self-defense further includes actuating the switch assembly with the thumb to deliver power to a flashlight head of the tool without changing grip on the tool. The method of self-defense still further includes striking with the tool without changing grip on the tool. The method of self-defense even further includes releasing with the thumb a safety engaged with the trigger when the trigger is moved from the unfired to the fired position.

It is therefore an object of the present invention to provide a tool for self-defense and safety that provides a light supply.

It is another object of the present invention to provide a tool for self-defense and safety that ejects a spray.

It is a further object of the present invention to provide a tool for self-defense and safety that provides a striking capability.

It is yet a further object of the present invention to provide a tool for self-defense and safety whereby a light supply may be activated, a spray may be ejected, or a strike may be made with changing grip on the tool.

Still other objects, features, and advantages of the present invention will become evident to those of ordinary skill in the art in light of the following detailed description.

BRIEF DESCRIPTION OF THE DRAWINGS

FIG. 1 is a side view in cross-section illustrating a self-defense and safety tool according to the preferred embodiment.

FIG. 2 is a cross-sectional view taken along lines 2,2 illustrating a body of the self-defense and safety tool.

FIG. 3 is a side view illustrating the self-defense and safety tool according to the preferred embodiment.

DETAILED DESCRIPTION OF THE PREFERRED EMBODIMENT

Figure 4:
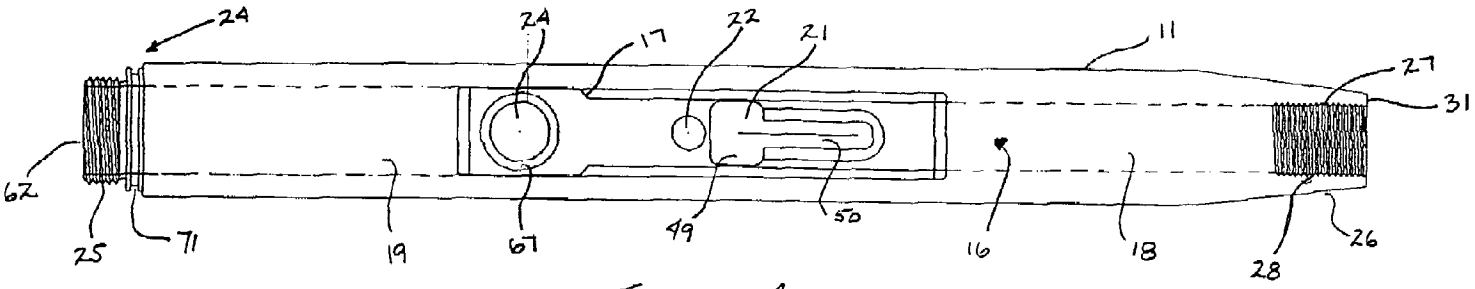
FIG. 4 is a top view illustrating the body of the self-defense and safety tool.
Figure 5C:
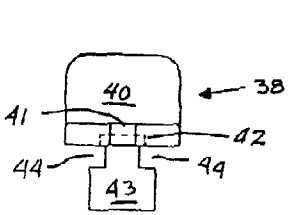
FIG. 5*c* is a rear view illustrating the trigger of the trigger assembly for the self-defense and safety tool.
Figure 5B:
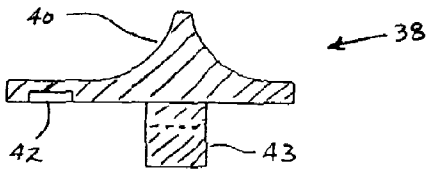
FIG. 5*b* is a side view in cross-section illustrating the trigger of the trigger assembly for the self-defense and safety tool.

As illustrated in the Figures, a tool 10 for self-defense and safety includes a body 11, a nozzle 12, a trigger assembly 13, a switch assembly 14, and a flashlight head 15. The body 11 includes a bore 16 therethrough and a detent 17 that separates the bore 16 into a canister compartment 18 and a flashlight compartment 19. The body 11 further includes a base 20 that provides a planar surface on the body 11 for the trigger assembly 13 and the switch assembly 14. The body 11 at the base 20 still further includes a trigger aperture 21, a safety aperture 22, a safety cavity 23, and a switch aperture 23. In this preferred embodiment, a first end 24 of the body 11 includes threads 25 that facilitate securing of the flashlight head 15 onto the body 11 in a position aligned with the axis of the body 11. Further, in this preferred embodiment, a second end 26 of the body 11 includes threads 27 within an entrance portion 28 into the canister chamber 18 defined by the bore 16. The threads 27 facilitate the securing of the nozzle 12 to the body 11 at the second end 26 thereof in a position aligned with the axis of the body 11.

Figure 7:
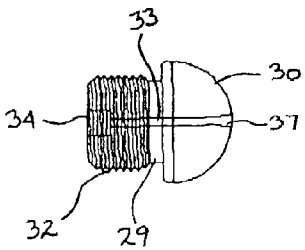
FIG. 7 is a side view illustrating a nozzle of the self-defense and safety tool.
Figure 6:
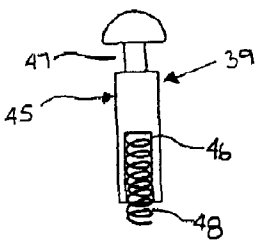
FIG. 6 is a side view illustrating a safety of the trigger assembly for the self-defense and safety tool.

The nozzle 12 (see particularly FIG. 7) includes a body 29 terminating in a tip 30. The body 29 fits within the entrance portion 28 of the canister chamber 18, and the tip 30 abuts a front edge 31 of the body 11. In this preferred embodiment, the body 29 of the nozzle 12 includes threads 32 that engage the threads 27 to facilitate the securing of the nozzle 12 to the body 11 at the second end 26 thereof. The nozzle 12 includes a passageway 33 that facilitates the delivery of a spray through the nozzle 12. The nozzle 12 may also include a cavity 32 at the exit of the passageway 33 to aid in the dispersion of a spray delivered through the nozzle 12. The nozzle 12 further includes a cavity 34 at the entrance into the passageway 33. The cavity 34 receives therein a delivery tube 35 of a spray canister 36 to align the spray canister 36 with the nozzle 12 and to facilitate the release of spray into the passageway 33. Spray thus released travels through the passageway 33 and exits the nozzle 12 at the second end 26 of the body 11.

The trigger assembly 13 (see particularly FIGS. 5*a-c* and 6) is movable between a locked or unfired position and a released or fired position and includes a trigger 38 and a safety 39. The trigger 38 includes an activation member 40, which in this preferred embodiment includes a ramped surface, and an aperture 41 located at the rear of the activation member 40 that terminates in a cavity 42 located in the under surface of the activation member 40. The trigger 38 further includes an engaging member 43 having removed portions 44. The safety 39 includes a locking member 45, having a cavity 46 therein and a groove 47 thereabout. The safety 39 further includes a biasing mechanism, which in this preferred embodiment is a spring 48, although any suitable biasing mechanism may be used.

In this preferred embodiment, the trigger aperture 20 is key-shaped and includes a head portion 49 and a neck portion 50 that permit the mounting of the trigger 38 to the body 11 at the base 20. Particularly, the engaging member 43 passes through the head portion 49 of the trigger aperture 21 until the activation member 40 abuts the base 20. At this point, the removed portions 44 of the engaging member 43 permit the sliding of the trigger 38 forward into the neck portion 50 of the trigger aperture 21. As the trigger 38 slides forward into the neck portion 50, the upper surface of the engaging member 43 at the removed portions 44 engages an underneath edge 61 of the canister compartment 18 to maintain the trigger 38 mounted to the body 11 at the base 20 (see particularly FIG. 2). Further, the engaging member 43 resides within the canister compartment 18 to affix the spray canister 36 within the canister compartment 18 such that the delivery tube 35 of the spray canister 36 resides within the cavity 34.

The base 20 and the neck portion 50 of the trigger aperture 21 permit the trigger 38 to slide forward to a position that exposes the safety aperture 22, thereby allowing the mounting of the safety 39 to the body 11 at the base 20. The spring 48 fits within the cavity 46, and the locking member 45 and the spring 48 pass through the safety aperture 22 and reside within the canister compartment 18. The safety cavity 23 receives the spring 48 and the locking member 45 therein to secure the safety 39 within the canister compartment 18. After the mounting of the safety 39, the groove 47 aligns with the aperture 41 of the activation member 40, and the trigger 38 slides rearward until the lower surface of the locking member 45 defining the groove 47 resides within the cavity 42 to maintain the locking member 45 within and abutting against the activation member 40. Consequently, in this preferred embodiment, the safety 39 assists in retaining the trigger 38 mounted to the body 11 at the base 20 by preventing the trigger 38 from sliding rearward into the head portion 49 of the trigger aperture 21.

The trigger assembly 13 begins in the locked or unfired position because the spring 48 biases the safety 39 against the trigger 38. In use, the nozzle 12 is removed from the body 11 and a spray canister 36 is slid into the canister compartment 18 until its rear end abuts the front face of the engaging member 43. The nozzle 12 is then replaced such that the delivery tube 35 of the canister 36 resides within the cavity 33 of the nozzle 12. In this preferred embodiment, the spray canister 36 ejects any suitable spray, such as pepper spray, mace, dye, and the like.

To fire spray from the spray canister 36, the body 11 is grasped underhanded with the thumb positioned over the trigger assembly 13. From that position, the top of the safety 39 is depressed, which disengages the locking member 45 from the cavity 42 of the activation member 40 due to the compression of the spring 48. The trigger 38 may now move forward because the groove 47 of the safety 39 is aligned with the aperture 41 of the activation member 40. Consequently, in the same motion that depresses the safety 39, the trigger 38 via the activation member 40 is moved forward along the neck portion 50 of the trigger aperture, thereby placing the trigger 38 in its released or fired position. Moreover, the engaging member 43 travels forward and compresses the delivery tube 35 of the spray canister 36 against the cavity 34 of the nozzle 12 facilitating release of spray from the spray canister 36. The spray ejects from the spray canister 36 via the delivery tube 35 and into the passageway 33 of the nozzle 12. The passageway 33 delivers the spray from the nozzle 202 and further serves to focus the spray onto a target.

Upon the release of the activation member 40 and thus the trigger 38, the delivery tube 35 decompresses from against the cavity 34 of the nozzle 12. The delivery tube 35 accordingly forces the spray canister 36 rearward, which, in turn, moves the engaging member 43 and thus the trigger 38 rearward. Particularly, the trigger 38 moves rearward until the lower surface of the locking member 45 defining the groove 47 resides within the cavity 42 so that the spring 48 biases the locking member 45 against the activating member 40, which again places the trigger 38 in its locked or unfired position. A biasing mechanism such as a spring may be inserted between the nozzle 12 and the spray canister 36 or the engaging member 43 and the spray canister 36 to aid in returning the trigger 38 to its locked or unfired position. Spray is thusly ejected from the tool 10 until the spray canister 36 is empty, at which point the spray canister 36 is removed and substituted with a filled one.

Figure 8B:
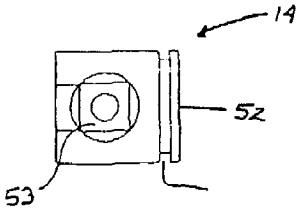
FIG. 8*b* is a top view illustrating the switch housing of the self-defense and safety tool including a switch disposed therein.
Figure 8A:
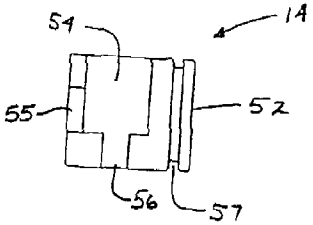
FIG. 8*a* is a side view illustrating a switch housing of the self-defense and safety tool.
Figure 5A:
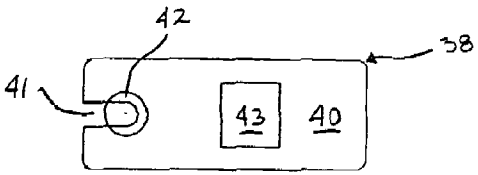
FIG. 5*a* is a bottom view illustrating a trigger of the trigger assembly for the self-defense and safety tool.

The switch assembly 14 (see particularly FIGS. 8*a* and *b*) includes a switch cap 51, a switch housing 52, and a switch 53. The switch cap 51 in this preferred embodiment includes a convex shape and is constructed from any suitable water resistant rubberized or plasticized material using well-known manufacturing techniques, such as vacuum forming or injection molding. The switch 53 in this preferred embodiment is a push-button type switch of well-known design and is available from Switch Channel, P.O. Box 31557, Los Angeles, Calif. 90031.

The switch housing 52 in this preferred embodiment is cylindrical in shape and has a diameter that permits frictional engagement with the inner walls of the flashlight compartment 19. The switch housing 52 provides a support platform for the switch 53 and is constructed from any suitable water resistant plastics material using well-known manufacturing techniques, such as machining or injection molding. The switch housing 52 includes a cavity 54, contact apertures 55 and 56, and a groove 57 that receives therein an o-ring 58. The switch 53 seats within the cavity 54 of the switch housing 52 and is held in place using any suitable means such as friction or an adhesive. A terminal 59 fits through the contact aperture 55 and electrically connects via soldering in this preferred embodiment to a positive contact of the switch 53, thereby forming a positive terminal 63 for the switch assembly 14. Similarly, a terminal 60 fits through the contact aperture 56 and electrically connects via soldering in this preferred embodiment to a negative contact of the switch 53, thereby forming a negative terminal 64 for the switch assembly 14.

Once the switch 53 has been seated within and electrically connected to the switch housing 52, the switch housing 52 inserts into the flashlight compartment 19 through an opening 62 at the first end 24 of the body 11. The switch housing 52 inserts into the flashlight compartment 19 until the switch housing 52 abuts the detent 17. The abutment of the switch housing 52 with the detent 17 and the o-ring 58 provide a fluid tight seal between the canister compartment 18 and the flashlight compartment 19. Further, when the switch housing 52 abuts the detent 17, the switch housing locates the switch 53 such that the switch 53 protrudes through the switch aperture 23 to permit activation of the switch 53 by a user of the tool 10. With the switch housing 52 properly located within the flashlight compartment 19 and the switch 53 protruding through the switch aperture 23, the switch cap 51 fits over the switch 53 and the switch aperture 23 and is frictionally held in place by a lip 67 of the switch aperture 23 in order to provide the switch assembly with a fluid tight seal. In addition, the positive terminal 63 protrudes into the flashlight compartment 19 to engage batteries 65 and 66, and the negative terminal 64 engages the flashlight compartment 19 to complete a circuit that powers the flashlight head 15 upon the activation of the switch 53 by a user.

The flashlight head 15 consists of a well-known design readily understood by those of ordinary skill in the art. The flashlight head 15 includes a housing 68 having threads 69 that engage the threads 25 to facilitate the securing of the flashlight head 15 onto the body 11 at the first end 24 thereof. An o-ring 70 disposed in a groove 71 located at the first end 24 of the body 11 provides a fluid tight seal between the flashlight head 15 and the body 11. The flashlight head 15 further includes a lens 72, a reflector 73, a bulb 74, a bulb contact 75, a base 76, and a spring 77. The lens 72 abuts a lip 78 of the housing 68 and is held in place by the reflector 73. An o-ring 80 disposed in a groove 79 located in the reflector 73 provides a fluid tight seal between the reflector 73 and the housing 68. The bulb 74 protrudes into the reflector 73, which reflects light produced by the bulb 74, thereby producing the flashlight beam. The bulb 74 electrically engages the bulb contact 75, which, in turn, resides within the base 76. The base 76 press fits within the housing 68 and employs the spring 77 to tension the reflector 73 against the lens 72 and thus against the lip 78 of the housing 68. The bulb contact 75 extends through the base 76 into the flashlight compartment 19 and includes a terminal 82 that engages the batteries 66 and 65 and a terminal 83 that contacts the housing 68 such that, upon the activation of the switch 53 by a user, the batteries power the bulb 74, thereby producing a beam of light emitted from the flashlight head 15. Although this preferred embodiment discloses a flashlight head 15 employing bulb technology, those of ordinary skill in the art will recognize other flashlight head technologies, such as LED, may be substituted.

The tool 10 is versatile and provides multiple self-defense and safety options to a user. Particularly, the location of the trigger assembly 13 proximate to the switch assembly 14 permits advantageous gripping of the tool 10 for self-defense and safety situations in that the user may actuate the trigger assembly 13 or the switch assembly 14 or strike with the tool 10 without changing grip. Illustratively, the user grips the tool 10 underhanded with the thumb positioned behind the safety 39. From that position, the user may raise the tool 10 to an overhand position and depress the switch 53 of the switch assembly 14, thereby powering the flashlight head 15. This provides quick illumination of a surrounding area and also allows a retinal flash to temporarily blind an assailant, thus permitting self-defense or escape. Further, from the underhanded position, the safety 39 may be released and the trigger 38 actuated in one simple motion as described above, which is extremely advantageous in self-defense situations. The underhanded grasping of the tool 10 also permits the activation of the trigger 38 to facilitate ejection of spray with the tool 10 held extended at full arms length, which prevents spray from accidentally landing on the face of the user. Moreover, the underhanded grasping of the tool 10 permits the ejection of spray at an upward angle, which is a most effective angle for ensuring the spray lands on the face of an assailant and enters the eyes, nose, and throat of the assailant. Still further, the tool 10 functions as an effective blunt instrument for thrusting into the body of an assailant, thereby rendering the assailant incapacitated.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description; rather, it is defined only by the claims that follow.

We claim:

1. A tool comprising:

a body defining a canister compartment and a flashlight compartment, wherein the body includes a trigger aperture and a safety aperture;

a flashlight head securable to the body at a first end;

a switch assembly housed by the body, wherein the switch assembly controls power delivery to the flashlight head from a battery disposed in the flashlight compartment;

a nozzle securable to the body at a second end; and a trigger assembly mounted on the body proximate to the switch assembly, wherein actuation of the trigger assembly ejects spray through the nozzle from a spray canister disposed in the canister compartment, further wherein either the trigger assembly or the switch assembly may be actuated without changing grip on the body, still further wherein the trigger assembly comprises:

a trigger mounted on the body and extending therein via the trigger aperture, wherein the trigger is movable between an unfired position and a fired position that ejects spray through the nozzle from a spray canister disposed in the canister compartment, and a safety mounted on the body and extending therein via the safety aperture, wherein the safety is coupled with the trigger to lock the trigger in the unfired position, further wherein release of the safety unlocks the trigger and permits movement of the trigger to the fired position.

2. The tool according to claim 1, wherein the trigger includes an aperture that terminates in a cavity engaged by the safety, wherein depression of the safety disengages the safety from the cavity and permits movement of the trigger to the fired position via the aperture.

3. The tool according to claim 1, wherein the trigger, comprises:

an engaging member disposed through the trigger aperture; and an activation member mounted on the body and coupled with the engaging member.

4. The tool according to claim 1, wherein the trigger assembly mounts on the body in a location that permits gripping of the body underhanded with the thumb positioned over the safety and the trigger to permit the thumb to release the safety and move the trigger from the unfired position to the fired position.

5. The tool according to claim 1, wherein the safety comprises:

a locking member disposed through the safety aperture; and a biasing mechanism that biases the locking member against the trigger.

6. The tool according to claim 1, wherein the nozzle includes a passageway therethrough.

7. The tool according to claim 6, wherein the nozzle includes a cavity communicating with the passageway, whereby the cavity receives a delivery tube of the spray canister therein.

8. The tool according to claim 1, wherein the switch assembly comprises:

a switch housing; and a switch disposed in the switch housing and electrically connected to a positive terminal and a negative terminal.

9. The tool according to claim 8, wherein the body includes a switch aperture.

10. The tool according to claim 9, wherein the switch housing is disposed in the body and the switch protrudes through the switch aperture to permit actuation thereof.

11. The tool according to claim 10, wherein the switch housing provides a fluid tight seal between the flashlight compartment and the canister compartment.

12. The tool according to claim 10, wherein the switch assembly further comprises a switch cap that mounts over the switch aperture.

13. The tool according to claim 1, wherein a user may strike with the tool without changing grip on the body.

* * * * *